US005877689A

United States Patent [19]

D'Amico

[11] Patent Number: 5,877,689

[45] Date of Patent: Mar. 2, 1999

[54] LEAK DETECTOR

[76] Inventor: Dan D'Amico, 37 Tarr Heights Dr., Canonsburg, Pa. 15317

[21] Appl. No.: 940,499

[22] Filed: Sep. 30, 1997

[51] Int. Cl.[6] ..... G08B 21/00

[52] U.S. Cl. ..... 340/605; 340/618; 340/623; 73/305; 73/307; 73/317; 137/312; 200/61.04

[58] Field of Search ..... 340/605, 606, 340/608, 618, 623; 137/78.1, 79, 31; 73/40, 305, 307, 317, 319; 200/84 R, 61.04

[56] References Cited

U.S. PATENT DOCUMENTS

| | | | |
|---|---|---|---|
| 4,126,857 | 11/1978 | Lancia et al. | 340/620 |
| 4,324,268 | 4/1982 | Jacobson | 137/312 |
| 4,845,472 | 7/1989 | Gordon et al. | 340/605 |
| 4,944,253 | 7/1990 | Bellofatto | 122/504 |
| 5,056,554 | 10/1991 | White | 137/486 |
| 5,099,873 | 3/1992 | Sanchez | 137/312 |
| 5,134,683 | 7/1992 | Powell | 392/449 |
| 5,188,143 | 2/1993 | Krebs | 137/312 |
| 5,315,291 | 5/1994 | Furr | 340/605 |
| 5,334,973 | 8/1994 | Furr | 340/605 |
| 5,345,224 | 9/1994 | Brown | 340/605 |
| 5,357,241 | 10/1994 | Welch, Jr. et al. | 340/605 |
| 5,632,302 | 5/1997 | Lenoir, Jr. | 137/312 |

*Primary Examiner*—Jeffery A. Hofsass
*Assistant Examiner*—Toan N. Pham

[57] ABSTRACT

A water appliance detection and cut off apparatus is provided including a water entry conduit for receiving water from a water source. A pan is provided having a bottom face and a lip coupled thereto and extending upwardly therefrom for defining an open top and an interior space into which the water appliance is stored. A water ball valve is connected to the water entry conduit. In use, the ball valve has a closed orientation upon at least the instantaneous receipt of an activation signal wherein water is prevented from flowing to the water appliance and an open orientation upon at least the instantaneous receipt of a deactivation signal wherein water is allowed to flow to the water appliance. At least one water sensor is situated within the interior space of the pan and is adapted to generate the activation signal upon the detection of water within the pan, wherein the water sensor is connected to the water ball valve for transmitting the activation signal thereto upon the detection of water thereby precluding water from flowing to the water appliance. A D-flip flop having an input is connected to the water sensors for continuously transmitting the activation signal at an output thereof upon at least the instantaneous receipt thereof until the receipt of the deactivation signal at a clear input thereof. Next provided is an audio alarm connected to the output of the D-flip flop for emitting an audible noise only during the receipt of the activation signal. Finally, a reset switch is connected to the clear input of the D-flip flop and the water ball valve for transmitting a deactivation signal thereto upon the depression thereof for resuming the flow of water to the water appliance.

3 Claims, 3 Drawing Sheets

LEAK DETECTOR

BACKGROUND OF THE INVENTION

1. Field of the Invention

The present invention relates to water leak detectors and more particularly pertains to a new LEAK DETECTOR for providing a unique means for indicating and preventing a leak associated with a water appliance.

2. Description of the Prior Art

The use of water leak detectors is known in the prior art. More specifically, water leak detectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art water leak detectors include U.S. Pat. No. 5,334,973; U.S. Pat. No. 5,345,224; U.S. Patent Des. 255, 102; U.S. Pat. No. 5,357,241; U.S. Pat. No. 5,153,564; and U.S. Pat. No. 4,896,052.

In these respects, the LEAK DETECTOR according to the present invention substantially departs from the conventional concepts and designs of the prior art, and in so doing provides an apparatus primarily developed for the purpose of providing a unique means for indicating and preventing a leak associated with a water appliance.

SUMMARY OF THE INVENTION

In view of the foregoing disadvantages inherent in the known types of water leak detectors now present in the prior art, the present invention provides a new LEAK DETECTOR construction wherein the same can be utilized for providing a unique means for indicating and preventing a leak associated with a water appliance.

The general purpose of the present invention, which will be described subsequently in greater detail, is to provide a new LEAK DETECTOR apparatus and method which has many of the advantages of the water leak detectors mentioned heretofore and many novel features that result in a new LEAK DETECTOR which is not anticipated, rendered obvious, suggested, or even implied by any of the prior art water leak detectors, either alone or in any combination thereof.

To attain this, the present invention generally comprises a water appliance having a water entry conduit for receiving water from a water source and a gas entry conduit for receiving gas from a gas source for powering purposes. The water appliance is further connected to a electrical power source via a plurality of wires for receiving electrical power therefrom. Such electrical power is employed for powering control means of the water appliance. Also showing FIG. 1 is a pan having a bottom face and a lip coupled thereto and extending upwardly therefrom. The lip thus defines an open top and an interior space into which the water appliance is stored. Further provided is a water ball valve connected to the water entry conduit. In operation, the ball valve has a closed orientation upon at least the instantaneous receipt of an activation signal. In the closed orientation, the ball valve prevents water from flowing to the water appliance. The ball valve further has an open orientation upon at least the instantaneous receipt of a deactivation signal, wherein water is allowed to flow to the water appliance. A gas valve is coupled to the gas entry conduit for precluding the flow of gas to the water appliance. It should be noted that the gas valve only operates in such a way during the receipt of power. Situated within the interior space of the pan is a plurality of water sensors. Each of the water sensors is adapted to generate the activation signal upon the detection of water within the pan. As shown in FIG. 3, the water sensors are connected to the water ball valve for transmitting the activation signal thereto upon the detection of water. As mentioned before, this precludes water from flowing to the water appliance. As shown in FIG. 3, a D-flip flop is provided having an input connected to the water sensors for continuously transmitting the activation signal at an output thereof upon at least the instantaneous receipt thereof. Such transmission continues until the receipt of the deactivation signal at a clear input thereof. For indicating that a true leak is occurring, a light emitting diode is connected to the water sensors for illuminating upon the receipt of the activation signal. Also included is a manual override switch connected between the light emitting diode and water sensors and the water ball valve and D-flip flop. Note FIG. 3. By such interconnection, the override switch is adapted for allowing the transmission of the activation signal to only the light emitting diode in a first orientation and further allow the transmission of the activation signal to the D-flip flop and the water ball valve in a second orientation. To provide an audible alarm when a leak is detected, an audio alarm means is connected to the output of the D-flip flop. As such, the alarm means is adapted for emitting an audible alarm only during the receipt of the activation signal. Connected between the electrical power source and the gas valve is a voltage controlled switch. Such voltage controlled switch is further connected to the output of the D-flip flop and serves to supply power to the gas valve only during the receipt of the activation signal. This in turn precludes the flow of gas to the water appliance. It should be noted that the voltage controlled switch is further connected to the wires between the electrical power source and the water appliance for precluding the supply of electrical power to the water appliance only during the receipt of the activation signal. The voltage control switch may comprises of dual relays or the like. Next provided is a reset switch connected to the clear input of the D-flip flop and the water ball valve. In use, the reset switch is adapted for transmitting a deactivation signal upon the depression thereof. Such depression thus resumes the flow of water, gas, and electrical power to the water appliance.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new LEAK DETECTOR apparatus and method which has many of the advantages of the water leak detectors mentioned heretofore and many novel features that result in a new LEAK DETECTOR which is not anticipated, rendered obvious, suggested, or even implied by any of the prior art water leak detectors, either alone or in any combination thereof.

It is another object of the present invention to provide a new LEAK DETECTOR which may be easily and efficiently manufactured and marketed.

It is a further object of the present invention to provide a new LEAK DETECTOR which is of a durable and reliable construction.

An even further object of the present invention is to provide a new LEAK DETECTOR which is susceptible of a low cost of manufacture with regard to both materials and labor, and which accordingly is then susceptible of low prices of sale to the consuming public, thereby making such LEAK DETECTOR economically available to the buying public.

Still yet another object of the present invention is to provide a new LEAK DETECTOR which provides in the apparatuses and methods of the prior art some of the advantages thereof, while simultaneously overcoming some of the disadvantages normally associated therewith.

Still another object of the present invention is to provide a new LEAK DETECTOR for providing a unique means for indicating and preventing a leak associated with a water appliance.

Even still another object of the present invention is to provide a new LEAK DETECTOR that includes a water entry conduit for receiving water from a water source. A pan is provided having a bottom face and a lip coupled thereto and extending upwardly therefrom for defining an open top and an interior space into which the water appliance is stored. A water ball valve is connected to the water entry conduit. In use, the ball valve has a closed orientation upon at least the instantaneous receipt of an activation signal wherein water is prevented from flowing to the water appliance and an open orientation upon at least the instantaneous receipt of a deactivation signal wherein water is allowed to flow to the water appliance. At least one water sensor is situated within the interior space of the pan and is adapted to generate the activation signal upon the detection of water within the pan, wherein the water sensor is connected to the water ball valve for transmitting the activation signal thereto upon the detection of water thereby precluding water from flowing to the water appliance. A D-flip flop having an input is connected to the water sensors for continuously transmitting the activation signal at an output thereof upon at least the instantaneous receipt thereof until the receipt of the deactivation signal at a clear input thereof. Next provided is an audio alarm connected to the output of the D-flip flop for emitting an audible noise only during the receipt of the activation signal. Finally, a reset switch is connected to the clear input of the D-flip flop and the water ball valve for transmitting a deactivation signal thereto upon the depression thereof for resuming the flow of water to the water appliance.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
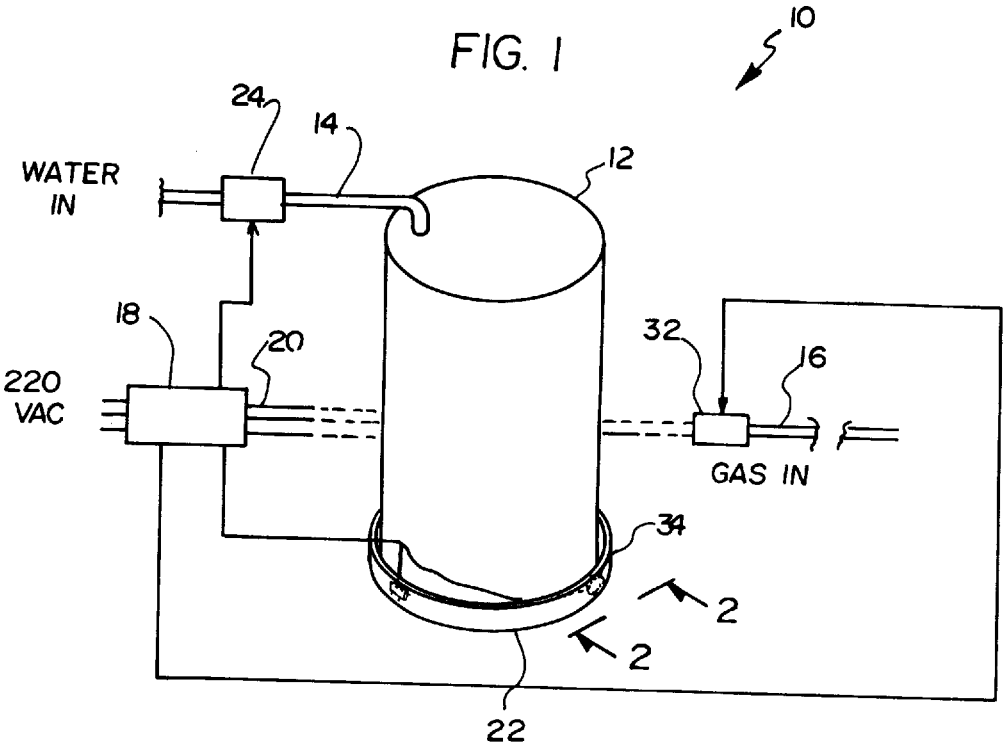
FIG. 1 is a perspective view of a new LEAK DETECTOR according to the present invention.
Figure 2:
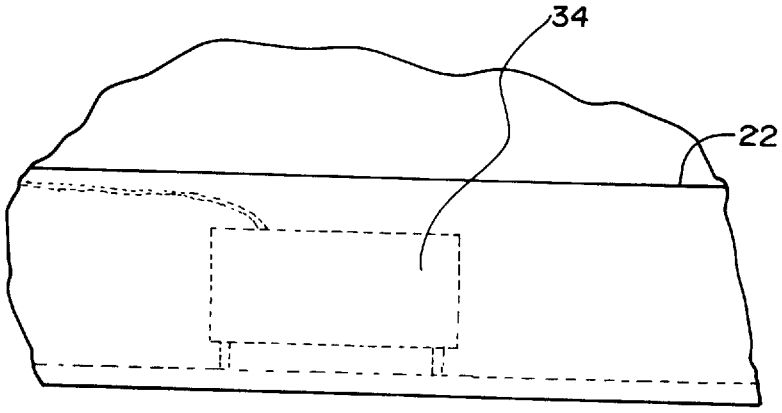
FIG. 2 is a close-up view of the water sensors of the present invention.

With reference now to the drawings, a new LEAK DETECTOR embodying the principles and concepts of the present invention and generally designated by the reference numeral 10 will be described.

As shown in FIG. 1, a water appliance 12 is provided having a water entry conduit 14 for receiving water from a water source and a gas entry conduit 16 for receiving gas from a gas source for powering purposes. The water appliance is further connected to a electrical power source 18 via a plurality of wires 20 for receiving electrical power therefrom. Such electrical power is employed for powering control means of the water appliance.

Also showing FIG. 1 is a pan 22 having a bottom face and a lip coupled thereto and extending upwardly therefrom. The lip thus defines an open top and an interior space into which the water appliance is stored.

Further provided is a water ball valve 24 connected to the water entry conduit. In operation, the ball valve has a closed orientation upon at least the instantaneous receipt of an activation signal. It should be noted that the activation signal simply consists of a pulse. In the closed orientation, the ball valve prevents water from flowing to the water appliance. The ball valve further has an open orientation upon at least the instantaneous receipt of a deactivation signal, wherein water is allowed to flow to the water appliance.

Figure 3:
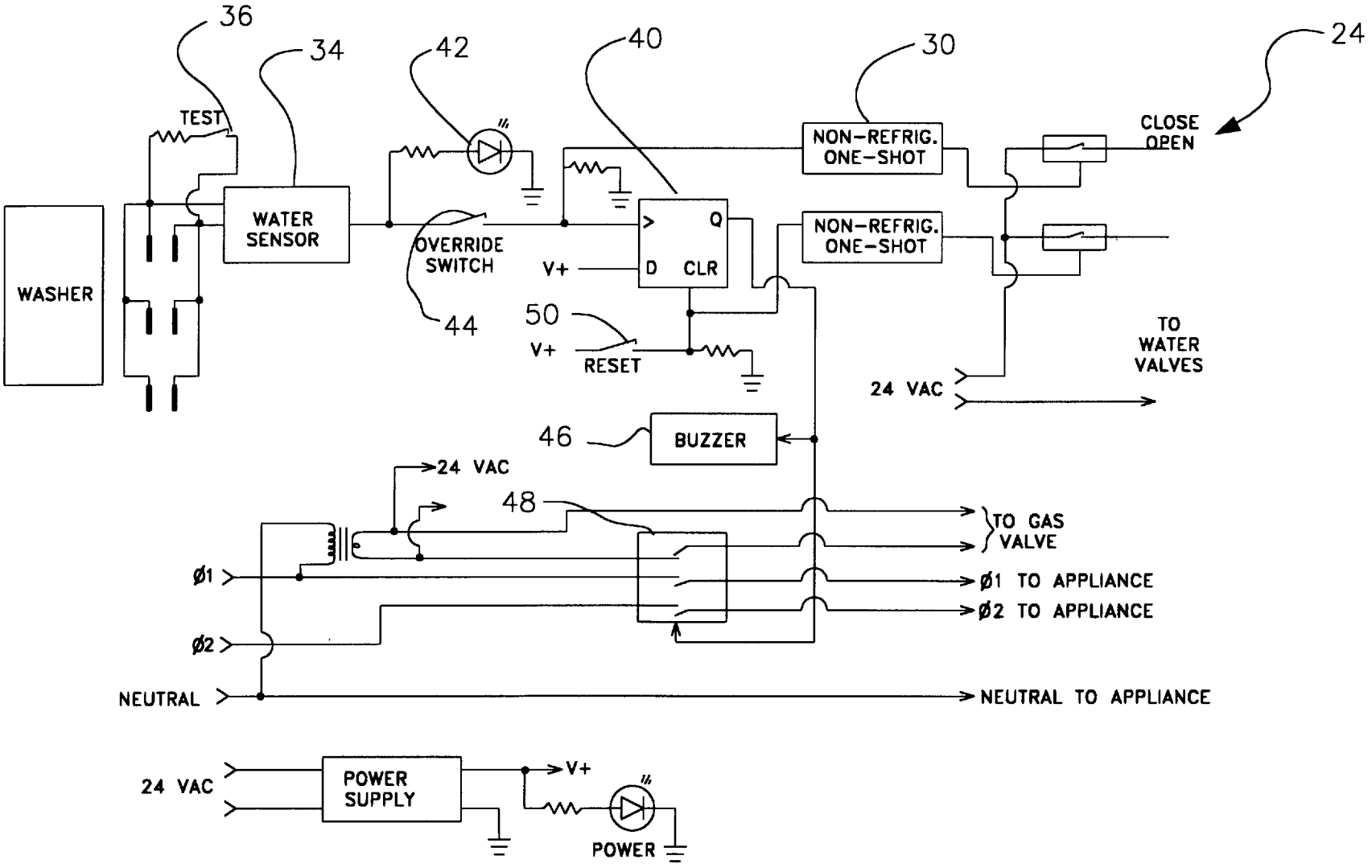
FIG. 3 is a schematic diagram of the various electrical components of the present invention.

As shown in FIG. 3, the ball valve receives the activation and deactivation signal via two separate inputs. It should be understood that the unique operation of the water ball valve is afforded by a way of a pair of non-retriggerable one-shot multivibrators 30 which permit the transmission of a pulse of proper duration despite the brevity of the activation and deactivation signals. In the preferred embodiment, the water ball valve preferably comprises a NIBCO AT585 valve.

A gas valve 32 is coupled to the gas entry conduit for precluding the flow of gas to the water appliance. It should be noted that the gas valve only operates in such a way during the receipt of power.

Situated within the interior space of the pan is a plurality of water sensors 34. Each of the water sensors is adapted to generate the activation signal upon the detection of water within the pan. As shown in FIG. 3, the water sensors are connected to the water ball valve for transmitting the activation signal thereto upon the detection of water. As mentioned before, this precludes water from flowing to the water appliance. For simulating the detection of water, a test button 36 is positioned in parallel with the water sensors for manually transmitting the activation signal.

As shown in FIG. 3, a D-flip flop 40 is provided having an input connected to the water sensors for continuously transmitting the activation signal at an output thereof upon at least the instantaneous receipt thereof. Such transmission continues until the receipt of the deactivation signal at a clear input thereof.

For indicating that a true leak is occurring, a light emitting diode 42 is connected to the water sensors for illuminating upon the receipt of the activation signal.

Also included is a manual override switch 44 connected between the light emitting diode and water sensors and the water ball valve and D-flip flop. Note FIG. 3. By such interconnection, the override switch is adapted for allowing the transmission of the activation signal to only the light emitting diode in a first orientation and further allow the transmission of the activation signal to the D-flip flop and the water ball valve in a second orientation. This allows the light emitting diode to unconditionally signal a leak.

To provide an audible alarm when a leak is detected, an audio alarm means 46, in the form of a buzzer, is connected to the output of the D-flip flop. As such, the alarm means is adapted for emitting an audible alarm only during the receipt of the activation signal.

Connected between the electrical power source and the gas valve is a voltage controlled switch 48. Such voltage controlled switch is further connected to the output of the D-flip flop and serves to supply power to the gas valve only during the receipt of the activation signal. This in turn precludes the flow of gas to the water appliance. It should be noted that the voltage controlled switch is further connected to the wires between the electrical power source and the water appliance for precluding the supply of electrical power to the water appliance only during the receipt of the activation signal. The voltage controlled switch may comprises of dual relays or the like.

Next provided is a reset switch 50 connected to the clear input of the D-flip flop and the water ball valve. In use, the reset switch is adapted for transmitting a deactivation signal upon the depression thereof. Such depression thus resumes the flow of water, gas, and electrical power to the water appliance. It is imperative that the various electrical components of the present invention are powered by a separate power source which is not affected by the voltage controlled switch.

Figure 4:
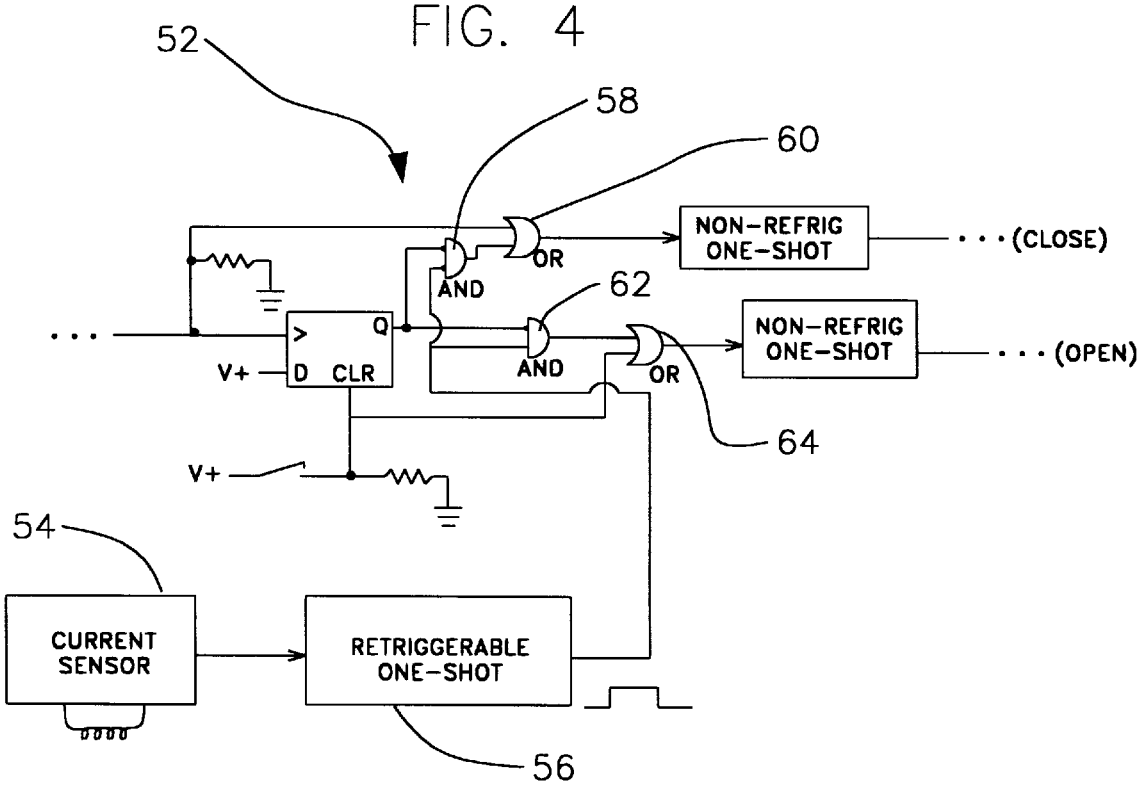
FIG. 4 is a schematic diagram of the circuitry associated with an alternate embodiment of the present invention.

In an alternate embodiment, the water sensors are situated adjacent a washer for transmitting the activation signal upon the detection of a leak. The present embodiment further includes means 52 for closing the water ball valve unconditionally after a predetermined amount of time if the washer is not consuming power as in the case where the washer has been deactivated. It should be noted that in the present embodiment, the gas and electrical power cutoff mechanism have been excluded for purposes of clarity. The means 52 includes a current sensor 54 adapted to provide a washer on signal for a predetermined amount of time upon each detection of the washer being activated. To accomplish this, the current sensor has associated therewith a retriggerable one-shot multivibrator 56. Further included is a first AND gate 58 with a pair of inverter inputs connected to the output of the D-flip flop and an output of the retriggerable one-shot multivibrator. As shown in FIG. 4, an output of the first AND gate is connected to a first input of a first OR gate 60. A second input of the first OR gate is connected to the water sensors while the output thereof is connected the water ball valve. By this interconnection, the water supplied to the washer will be cut off by either the detection of water or the deactivation of the washer. To effect the opening of the water ball valve upon either the depression of the reset button or the lack of detection of water in combination with the activation of the washer, a second AND gate 62 and OR gate 64 are provided. The second AND gate has a first inverter input connected to the output of the D-flip flop and a second input connected to the retriggerable one-shot multivibrator. The second AND gate further has an output connected to a first input of the second OR gate. A second input of such OR gate is connected to the reset button. By this structure, the forgoing function is accomplished.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water appliance detection and cut off apparatus comprising, in combination:

a water appliance having a water entry conduit for receiving water from a water source and a gas entry conduit for receiving gas from a gas source for powering purposes, the water appliance further connected to a electrical power source via a plurality of wires for receiving electrical power therefrom for powering control means of the water appliance;

a pan having a bottom face and a lip coupled thereto and extending upwardly therefrom for defining an open top and an interior space into which the water appliance is stored;

a water ball valve connected to the water entry conduit, the ball valve having a closed orientation upon at least the instantaneous receipt of an activation signal wherein water is prevented from flowing to the water appliance and an open orientation upon at least the instantaneous receipt of a deactivation signal wherein water is allowed to flow to the water appliance;

a gas valve coupled to the gas entry conduit for precluding the flow of gas to the water appliance only during the receipt of power;

a plurality of water sensors each situated within the interior space of the pan and each adapted to generate the activation signal upon the detection of water within the pan, wherein the water sensors are connected to the water ball valve for transmitting the activation signal thereto upon the detection of water thereby precluding water from flowing to the water appliance;

a light emitting diode connected to the water sensors for illuminating upon the receipt of the activation signal thereby indicating a true leak;

a D-flip flop having an input connected to the water sensors for continuously transmitting the activation signal at an output thereof upon at least the instantaneous receipt thereof until the receipt of the deactivation signal at a clear input thereof;

a manual override switch connected between the light emitting diode and water sensors and the water ball valve and D-flip flop for allowing the transmission of the activation signal to only the light emitting diode in a first orientation and further allow the transmission of the activation signal to the D-flip flop and the water ball valve in a second orientation;

an audio alarm means connected to the output of the D-flip flop for emitting an audible alarm only during the receipt of the activation signal;

a voltage controlled switch connected between the electrical power source and the gas valve, the voltage controlled switch further connected to the output of the D-flip flop for supplying power to the gas valve only during the receipt of the activation signal thereby precluding the flow of gas to the water appliance, the voltage controlled switch further connected to the wires between the electrical power source and the water appliance for precluding the supply of electrical power to the water appliance only during the receipt of the activation signal; and a reset switch connected to the clear input of the D-flip flop and the water ball valve for transmitting a deactivation signal thereto upon the depression thereof for resuming the flow of water, gas, and electrical power to the water appliance.

2. A water appliance detection and cut off apparatus comprising;

a water appliance having a water entry conduit for receiving water from a water source, the water appliance further connected to a power source for electrical power, a pan having a bottom face and a lip coupled thereto and extending upwardly therefrom for defining an open top and an interior space into which the water appliance is stored;

a water ball valve connected to the water entry conduit, the ball valve having a closed orientation upon at least the instantaneous receipt of an activation signal wherein water is prevented from flowing to the water appliance and an open orientation upon at least the instantaneous receipt of a deactivation signal wherein water is allowed to flow to the water appliance;

a power cutoff means coupled between the power source and the water appliance for precluding the flow of power to the water appliance only during the receipt of the activation signal;

at least one water sensor situated within the interior space of the pan and adapted to generate the activation signal upon the detection of water within the pan, wherein the water sensor is connected to the water ball valve for transmitting the activation signal thereto upon the detection of water thereby precluding water from flowing to the water appliance;

a D-flip flop having an input connected to the water sensors for continuously transmitting the activation signal at an output thereof upon at least the instantaneous receipt thereof until the receipt of the deactivation signal at a clear input thereof, wherein the output of the D-flip flop is connected to the power cut off means;

an audio alarm means connected to the output of the D-flip flop for emitting an audible alarm only during the receipt of the activation signal;

a reset switch connected to the clear input of the D-flip flop and the water ball valve for transmitting a deactivation signal thereto upon the depression thereof for resuming the flow of water and power to the water appliance;

a light emitting diode connected to the water sensors for illuminating upon the receipt of the activation signal thereby indicating a true leak; and a manual override switch connected between the light emitting diode and water sensors and the water ball valve and D-flip flop for allowing the transmission of the activation signal to only the light emitting diode in a first orientation and further allow the transmission of the activation signal to the D-flip flop and the water ball valve in a second orientation.

3. A water appliance detection and cut off apparatus comprising:

a water appliance having a water entry conduit for receiving water from a water source;

a pan having a bottom face and a lip coupled thereto and extending upwardly therefrom for defining an open top and an interior space into which the water appliance is stored;

a water ball valve connected to the water entry conduit, the ball valve having a closed orientation upon at least the instantaneous receipt of an activation signal wherein water is prevented from flowing to the water appliance and an open orientation upon at least the instantaneous receipt of a deactivation signal wherein water is allowed to flow to the water appliance;

at least one water sensor situated within the interior space of the pan and each adapted to generate the activation signal upon the detection of water within the pan, wherein the water sensor is connected to the water ball valve for transmitting the activation signal thereto upon the detection of water thereby precluding water from flowing to the water appliance;

a D-flip flop having an input connected to the water sensors for continuously transmitting the activation signal at an output thereof upon at least the instantaneous receipt thereof until the receipt of the deactivation signal at a clear input thereof;

an audio alarm means connected to the output of the D-flip flop for emitting an audible alarm only during the receipt of the activation signal; and a reset switch connected to the clear input of the D-flip flop and the water ball valve for transmitting a deactivation signal thereto upon the depression thereof for resuming the flow of water to the water appliance;

wherein the appliance is a washer;

wherein the water sensor is adapted for transmitting the activation signal upon the detection of a leak, the apparatus further including means for closing the water ball valve unconditionally after a predetermined amount of time if the washer is not consuming power as in the case where the washer is deactivated.

* * * * *